US005553795A

United States Patent [19]

Tsai et al.

[11] Patent Number: 5,553,795

[45] Date of Patent: Sep. 10, 1996

[54] INERTIAL IMPACTOR WITH A SPECIALLY DESIGNED IMPACTION PLATE

[75] Inventors: Chuen J. Tsai; Yu H. Cheng, both of Hsinchu, Taiwan

[73] Assignee: National Science Council of Republic of China, Taiwan

[21] Appl. No.: 436,727

[22] Filed: May 8, 1995

[51] Int. Cl.[6] ..... B02C 19/06

[52] U.S. Cl. ..... 241/40

[58] Field of Search ..... 241/5, 39, 40

[56] References Cited

U.S. PATENT DOCUMENTS

| | | | |
|---|---|---|---|
| 2,765,122 | 10/1956 | Trost | 241/40 |
| 4,284,245 | 8/1981 | Fishgal | 241/40 |
| 4,619,406 | 10/1986 | Fishgal | 241/40 X |

FOREIGN PATENT DOCUMENTS

| | | | |
|---|---|---|---|
| 910191 | 3/1982 | U.S.S.R. | 241/40 |
| 358007 | 12/1931 | United Kingdom | 241/40 |

*Primary Examiner*—Mark Rosenbaum
*Attorney, Agent, or Firm*—Bacon & Thomas

[57] ABSTRACT

An inertial impactor with a specially designed impaction plate has a nozzle protruding from a nozzle plate, and an impaction plate formed with a conical recess covered by an orifice plate and a circular impaction plane at the bottom of the recess having a diameter slightly greater than that of the diameter of the nozzle. The impactor reduces loss of particles due to rebounding or blowing off particles from the impaction plate so as to increase particle collection efficiency and capacity, permit a quick accumulation of the particles on the bottom of the conical recess, and increase collection efficiency accordingly.

2 Claims, 7 Drawing Sheets

INERTIAL IMPACTOR WITH A SPECIALLY DESIGNED IMPACTION PLATE

BACKGROUND OF THE INVENTION

As one of the widely used atmospheric particle samplers an impactor is used for measurement of aerosol size distribution and collection of samples for further chemical analysis. Though it has been used widely, there are still problems to be overcome. When the suspended particles are liquid, its actual collection efficiency is very close to the theoretical collection efficiency. However, when it is used in the collection of solid particles, the collection efficiency is much lower than the theoretical efficiency because solid particles will rebound from the impaction plate, and the rebounded particles can be easily carried away by the aerosol stream if the conventional fiat impaction plate is used.

There are ways to reduce particle rebounding from the impaction plate, such as application of grease on the surface of the impaction plate. However, two essential questions exist in this method: firstly the chemical properties of the grease itself will interfere with chemical analysis of the collected particles; and secondly the incoming particles will rebound from the particles that have been adhered to the impaction plate. Consequently the collection efficiency is lowered.

Blowing away of the particles from the impaction plate is another problem of the conventional impactor. When the particles have been accumulated to a certain thickness on the plate, the particles will be blown away by the air stream, causing another loss of particles.

SUMMARY OF THE INVENTION

The main objective of the present invention is to provide an inertial impactor with a specially designed impaction plate to eliminate the aforesaid problems. It comprises a nozzle protruding from the nozzle plate; an impaction plate and formed with a conical recess covered by an orifice plate, and a circular plane at the bottom of the recess having a diameter slightly greater than the nozzle. This design is to change the direction of incoming or rebounding particles in the conventional inertial impactor with a flat plate, in order to recapture rebounding particles and to overcome the problem of blowing away of particles from the impaction plate which results in lowering of collection efficiency, and to increase the collection capacity of the impaction plate.

BRIEF DESCRIPTION OF THE DRAWINGS

The invention, as well as its many advantages, may be further understood by the following detailed description and in which.

DETAILED DESCRIPTION OF THE PREFERRED EMBODIMENT

Figure 1:
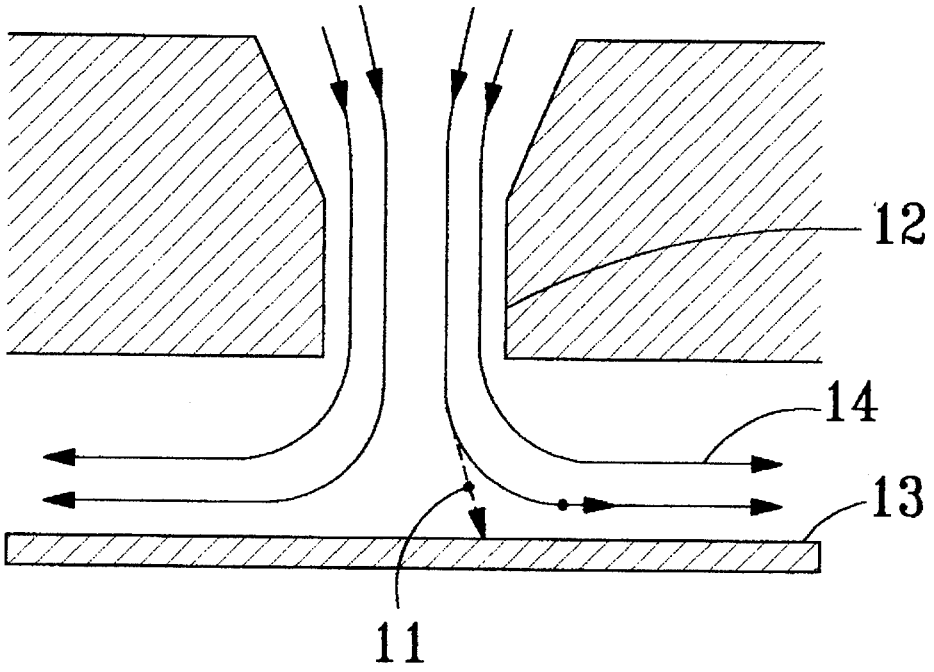
FIG. 1 illustrates the principle of particle collection by the inertial impactor.

Please refer to FIG. 1 which illustrates the principle of particle collection in a typical inertial impactor. As the particles 11 in an aerosol stream are passing through the nozzle 12, the air stream is accelerated so that the particles 11 in the stream have a greater inertia. When the air stream impinges upon an impaction plate 13, the particles 11 with sufficient inertia deviate from their respective streamlines 14 and impinge upon the impaction plate 13.

Figure 2:
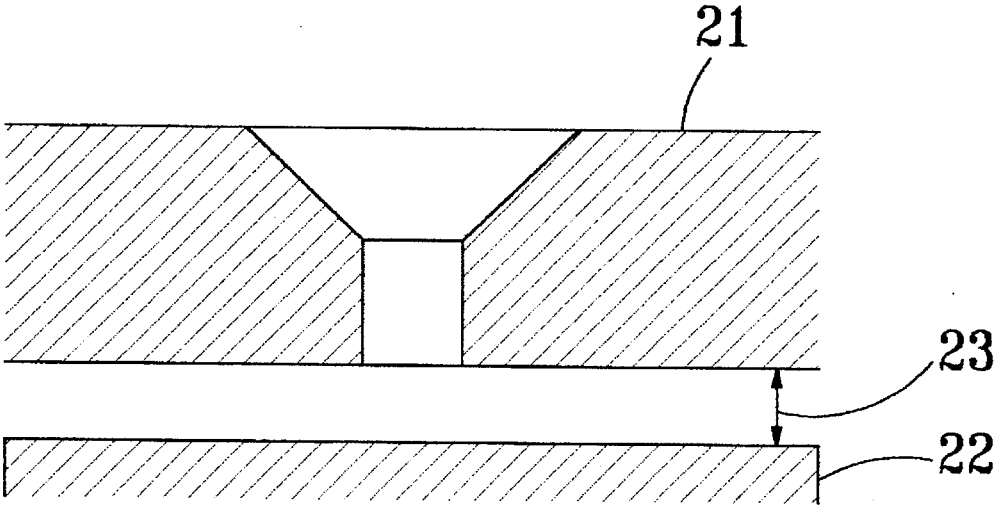
FIG. 2 is a sectional view of a conventional inertial impactor with a flat impaction plate.

As shown in FIG. 2, a sectional view of a conventional inertial impactor with a flat impaction plate, it comprises mainly a nozzle element 21 and a flat impaction plate 22. There is a gap 23 between the nozzle element 21 and the impaction plate 22. The particles 11 rebounding from the flat impaction plate 22 can be easily brought away from the flat impaction plate 22 by the air stream. Then, the actual collection efficiency is much lower than the theoretical collection efficiency. Moreover, after the particles 11 are accumulated on the impaction plate 22 to a certain thickness, the particles 11 can be blown away by the air stream, resulting in loss of particles 11.

Figure 3A:
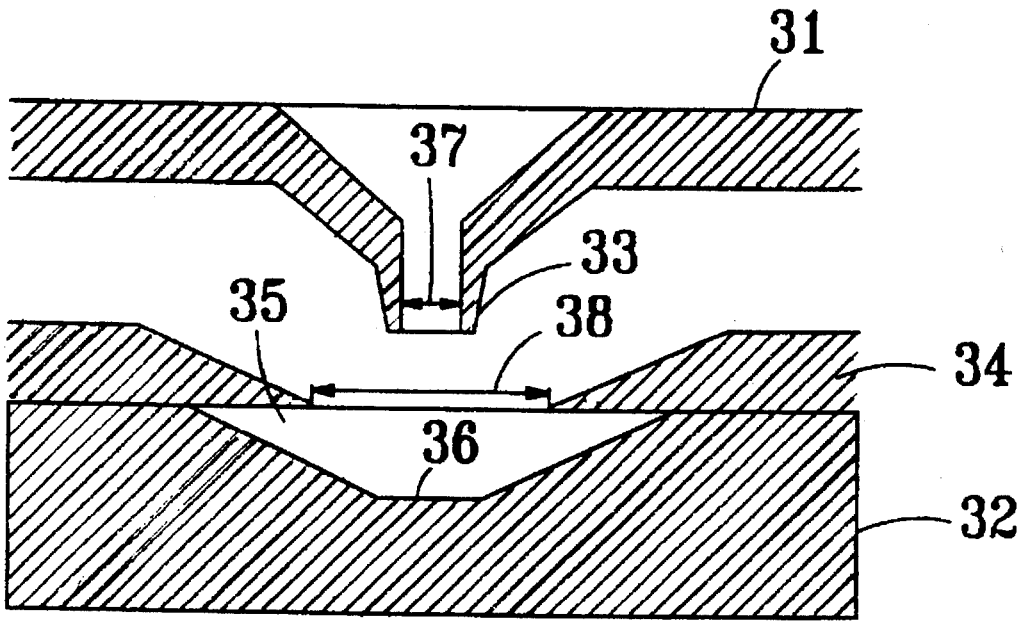
FIG. 3A and 3B are sectional views of inertial impactors according to the present invention.
Figure 3B:
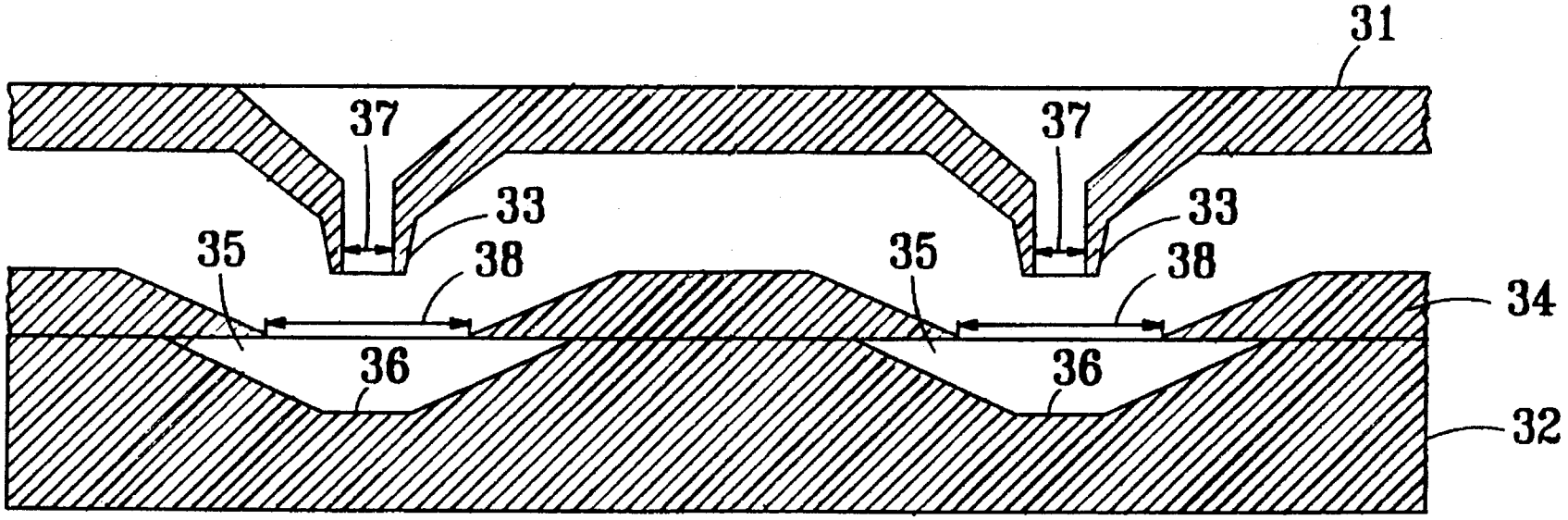

FIGS. 3A and 3B are sectional view of an inertial impactor according to the present invention. The impactor according to the present invention comprises a nozzle element 31 and an impaction plate 32. The nozzle element 31 has a protruding nozzle 33, and the impaction plate 32 is formed with a conical recess 35 covered by an orifice plate 34. A circular impaction plane 36 with a diameter slightly greater than the diameter 37 of the nozzle 33 is located at the bottom of the conical recess 35, which is designed so that the collection efficiency curve for the particles 11 is relatively close to the Marple's theoretical collection efficiency curve (Marple, V. A. and Liu B.Y.H., Characteristics of Laminar Jet Impactor, Environmental Science and Technology, Vol. 8, pp 648–654, 1974). The orifice diameter 38 of the orifice plate 34 is about four times of the diameter 37 of the nozzle 33. It is an appropriate size which prevents loss of particles 11 due to unfavorable exiting flow direction if the orifice size is too small, and loss of particles 11 due to blowing out in case the orifice size is too large. It is a design which effectively retains the particles 11 within the conical recess 35 and prevents the particles 11 from being blown out of the conical recess 35 by the air stream. The particles 11 can also be accumulated quickly on the bottom of the conical recess 35 to improve collection efficiency.

Figure 4:
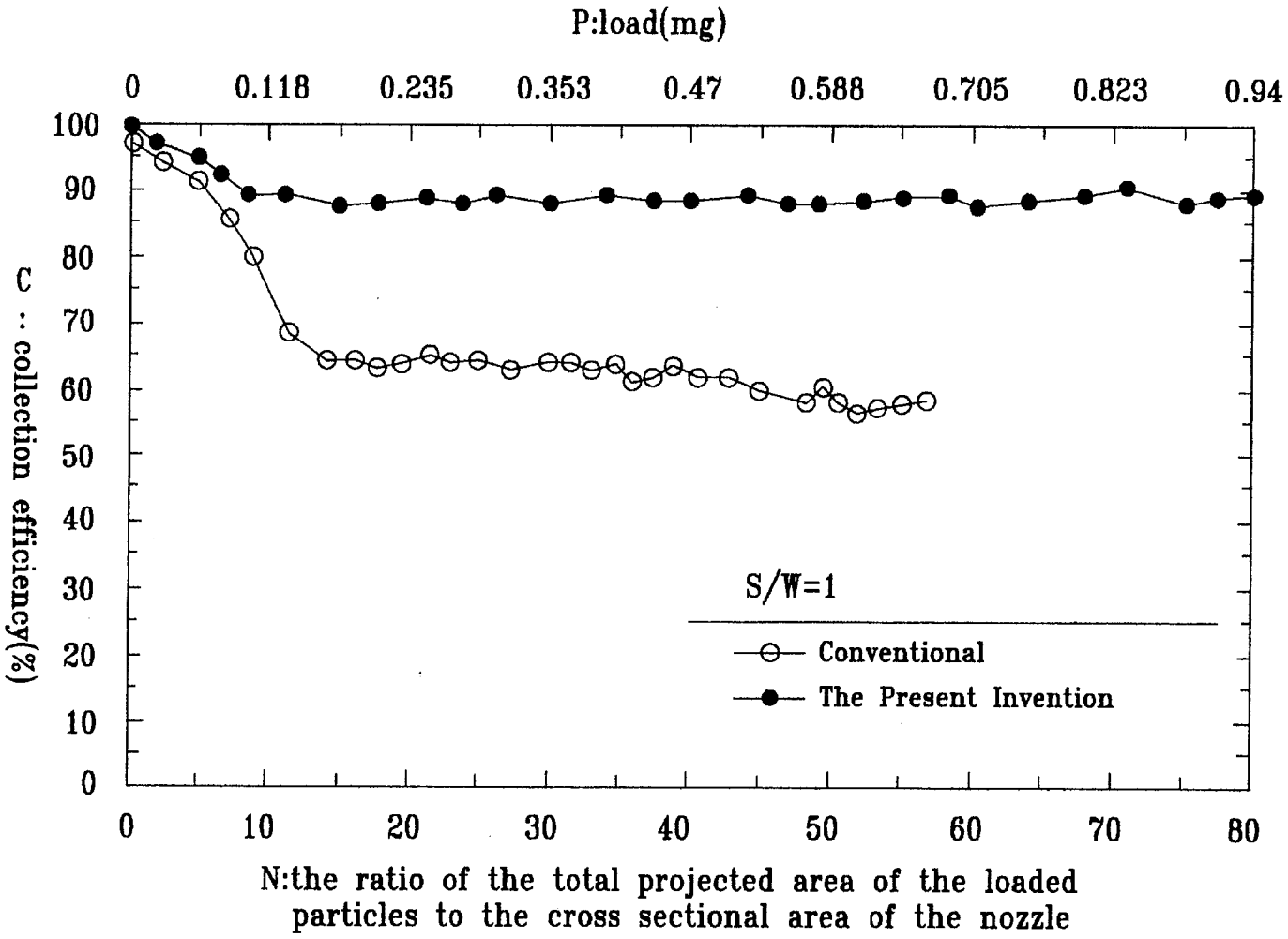
FIG. 4 is a graph illustrating the relationship between the collection efficiency for solid particles and particle loading (with greased impaction plate)

FIG. 4 shows the relationship between the solid particle collection efficiency and particle loading with greased impaction plate. The upper horizontal axis represents loading in mg (P), the lower horizontal axis represents the dimensionless number of particle layers (N) which is the ratio of the total projected area of the loaded particles to the cross sectional area of the nozzle, and the vertical axis represents the collection efficiency (C) in percentage. As shown in FIG. 4, it has been proved by experiment that, there is no significant difference in initial collection efficiency between the present invention and the conventional impactor. However, as the particles 11 gradually accumulate on the impaction plate, the collection efficiency of the conventional impactor drops rapidly while that of the present invention maintains relatively high and stable after particle loading reaches a certain level.

Figure 5A:
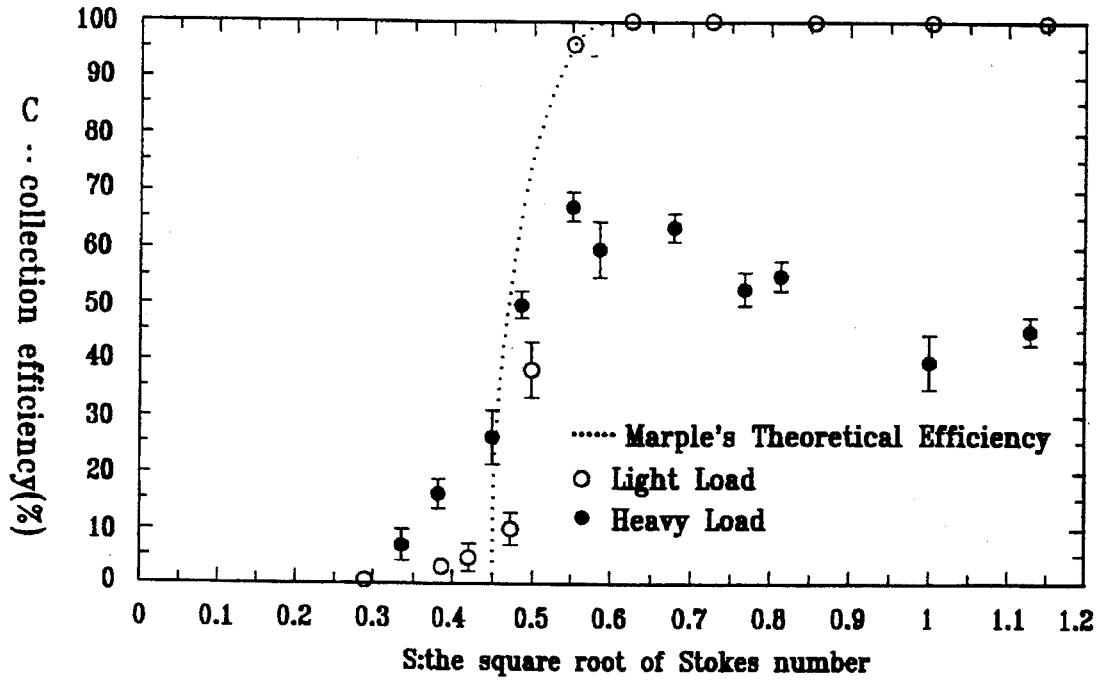
FIG. 5A is a graphical representation illustrating the relationship between the collection efficiency and the square root of the Stokes number by the conventional inertial impactor with a flat impaction plate.
Figure 5B:
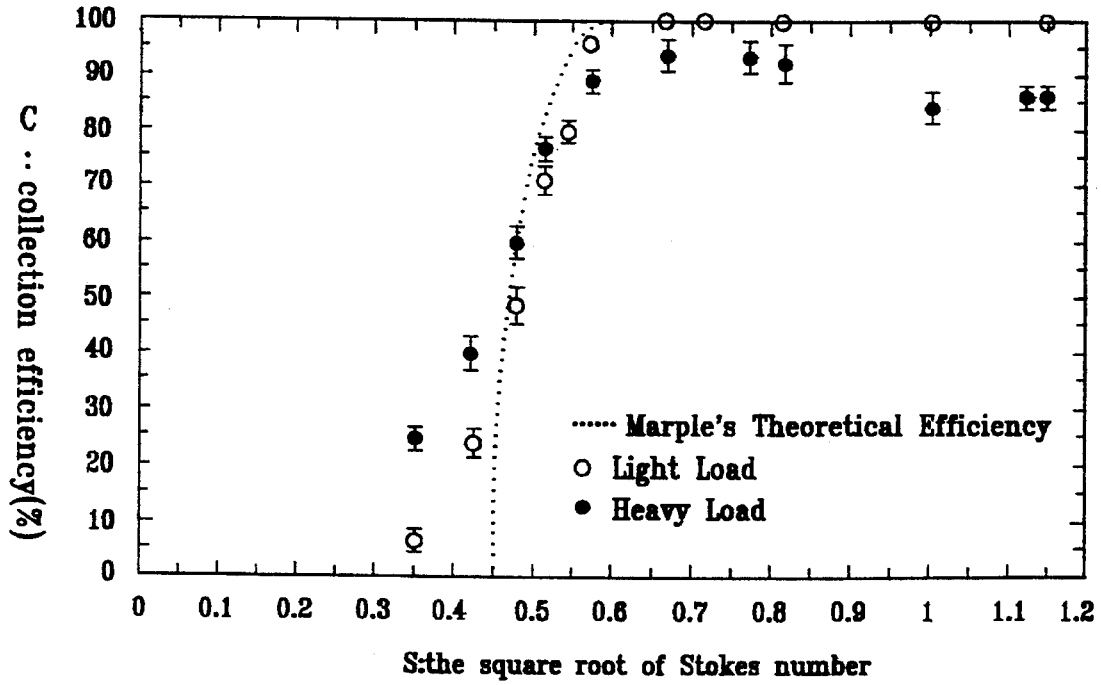
FIG. 5B is a graphical representation the relationship between the collection efficiency for solid particles and the square root of the Stokes number by the present invention (with ungreased impaction plate)

FIGS. 5A and 5B illustrate the relationship between the solid particle collection efficiency and a dimensionless particle size expressed in the square root of the Stokes number in the inertial impaction with a greased conventional flat impaction plate and the present invention with a greased impaction plate respectively. In these figures, the horizontal axis represents the square root of the Stokes number (S), while the vertical axis represents the collection efficiency (C) in percentage. From these figures it can be seen that the present invention has a collection efficiency very similar to the conventional impactor when particle loading is light. However, when the particles loading is heavy, the collection efficiency of the conventional impactor falls down significantly, being only 40% to 70% at a high Stokes number. But with the present invention, a relatively high collection efficiency of up to 85% to 90% can be maintained at a high Stokes number because the present invention recaptures the rebounded particles 11. After the particles loading on the impaction plate 32 has reached a certain value, the collection efficiency for the particles 11 maintained nearly constant.

Conventionally the Stokes number is defined as the ratio of the particle stopping distance to the halfwidth of the radius of the impactor throat, expressed as:

$$Stk = \frac{\rho_0 d_a^2 U C_c}{9\mu d_1}$$

in which $d_a$=particle diameter

U=mean air velocity at the throat $C_c$=slip correction factor $d_1$=diameter of circular throat or width of rectangular throat $\rho_0$=particle density Normally, the impaction efficiency of impactor varies according to the Stokes number.

Figure 6:
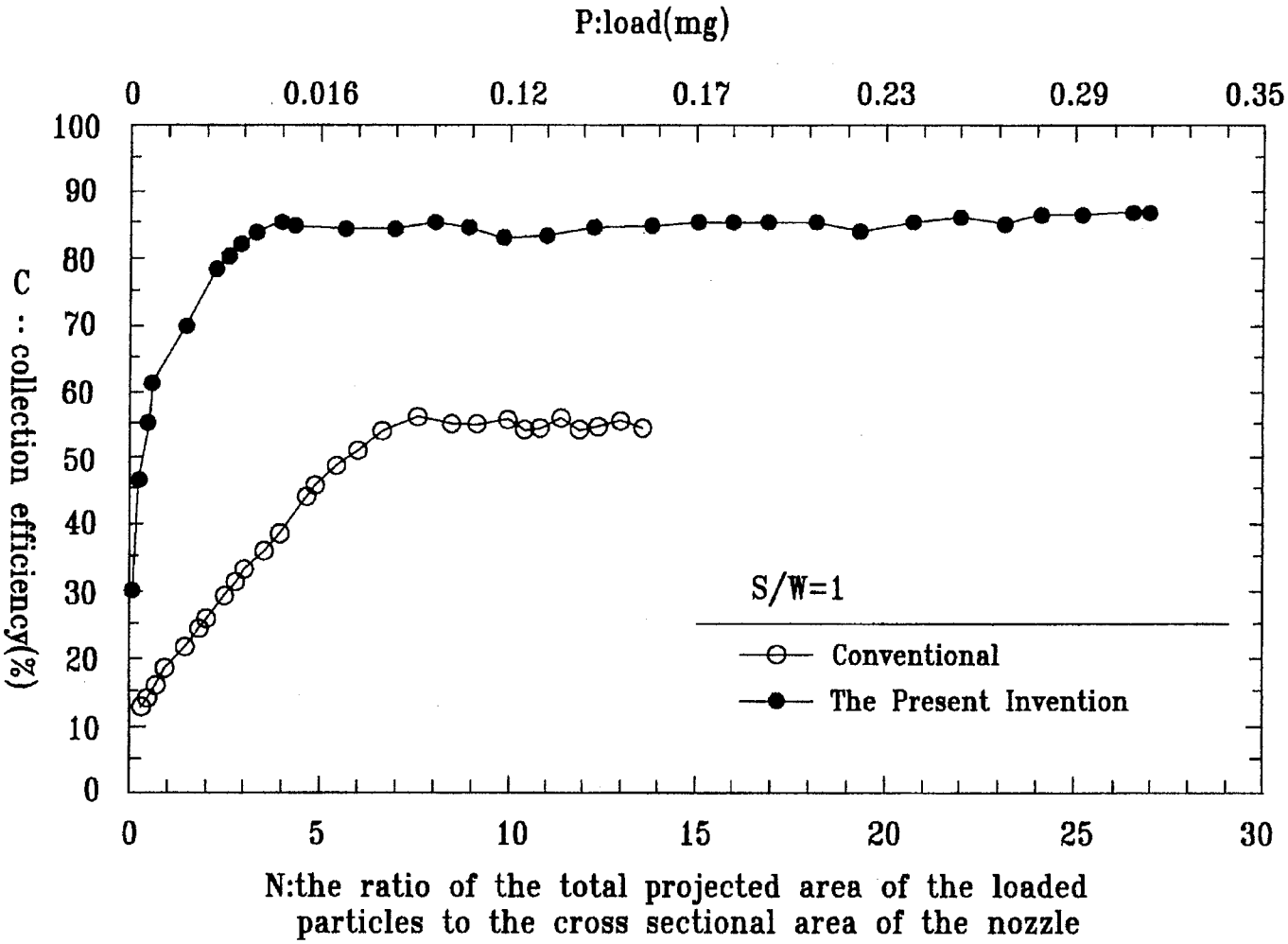
FIG. 6 is a graph illustrating the relationship between the collection for solid particles and the square root of the Stokes number (with ungreased impaction plate)

Please refer to FIG. 6 for the collection efficiency for solid particles and particle loading (with ungreased impaction plate). In this figure, the upper horizontal axis represents particle loading in mg (P); the lower horizontal axis represents the dimensionless number of particle layers (N) which is the ratio of the total projected area of the loaded particles to the cross sectional area of the nozzle; and the vertical axis represents collection efficiency, % (C). In the initial sampling stage, both the present invention and the conventional impactor will encounter rebounding of the particles 11. But in the present invention, because the particles 11 accumulate on the bottom of the conical recess 35 rapidly, the collection efficiency also increases rapidly. The rapid increase in collection efficiency is due to the displacement or turning of the previously deposited particles 11 by the incoming particles 11 and the consequent lowering of the rebounding energy. Moreover, the incoming particles 11 may impinge on a lateral side of the previously deposited particles. This phenomenon increases a force component for downward movement during particle rebounding, and consequently lowers the possibility of rebounding and improves the collection efficiency. As a result, the present invention can recapture rebounding particles efficiently and raise the collection efficiency to 85% rapidly. On the other hand, the collection efficiency of the conventional impactor increases slowly with particle loading. Its maximum collection efficiency is only 55%.

Figure 7A:
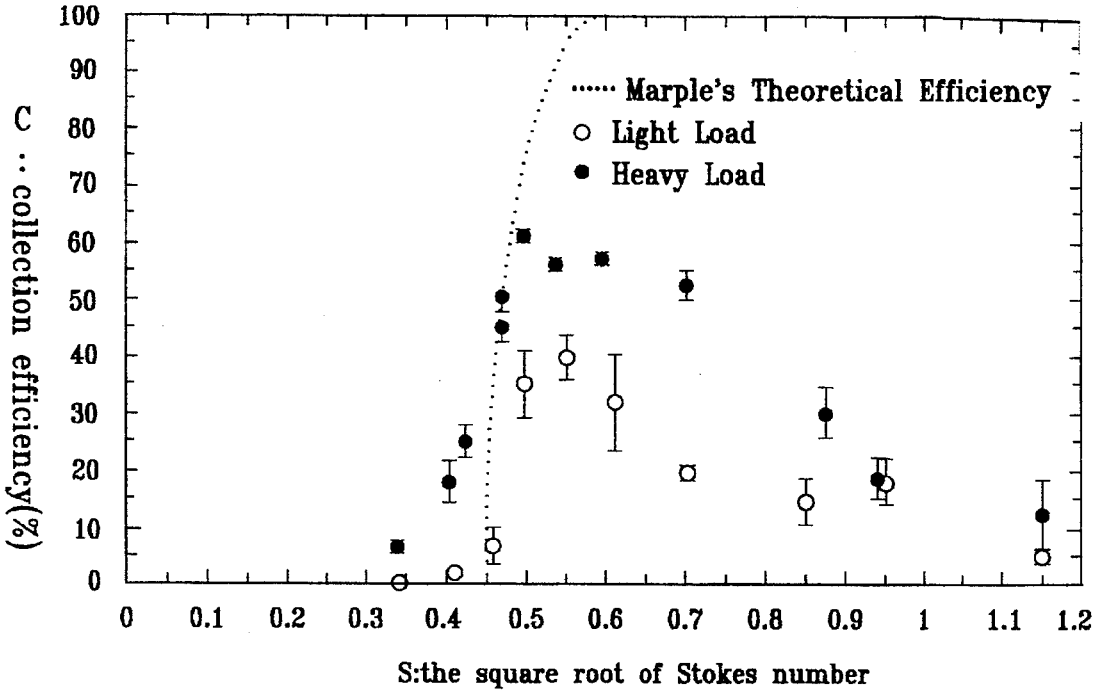
FIG. 7A is a graphical representation illustrating the relationship between the collection for solid particles and the square root of the Stokes number by the conventional inertial impactor with a flat impaction plate (ungreased)
Figure 7B:
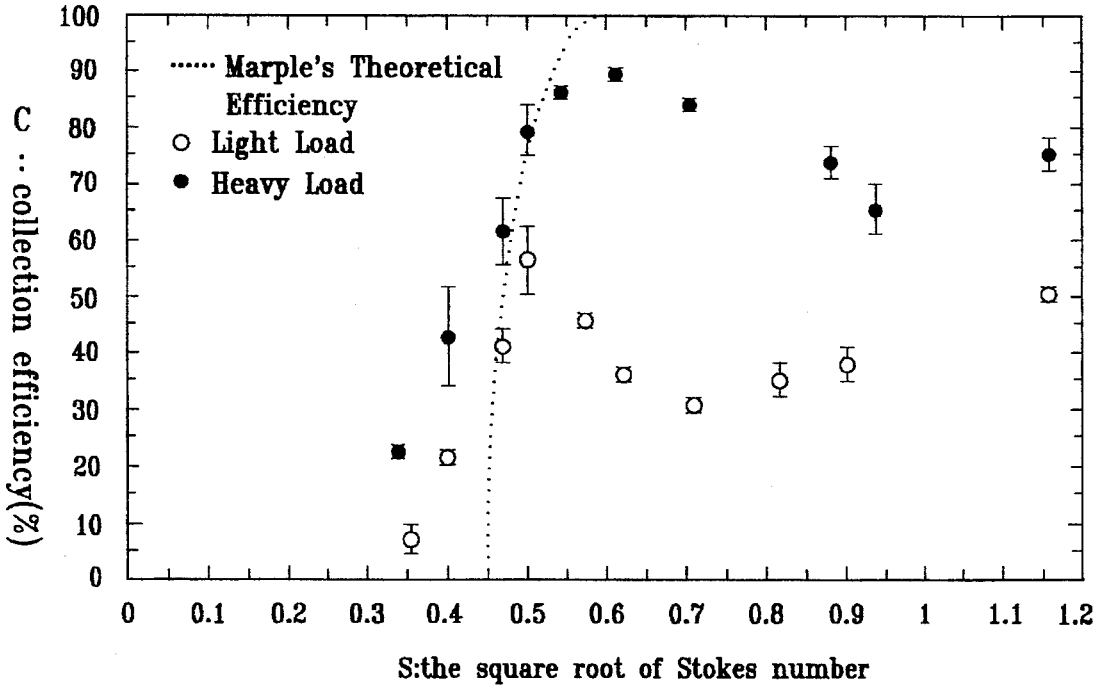
FIG. 7B is a graphical representation illustrating the relationship between the collection efficiency and the square root of the Stokes number by the present invention (with ungreased impaction plate).

FIGS. 7A and 7B illustrate the collection efficiency for solid particles and the square root of the Stokes number for the conventional inertial impactor with a flat impaction plate and the impactor according to the present invention (all with ungreased impaction plate) respectively. In these figures the horizontal axis represents the square root of the Stokes number (S), the vertical axis represents collection efficiency, % (C). From these figures it can be seen that the collection efficiency achieved by the present invention is much higher than the conventional impactor.

As described above, the present invention has the following advantages:

1. Under the same S/W ratio (where S is the jet-to-plate distance and W is the jet width or diameter), the present invention lowers radial fluid speed so that less rebounded solid particles will be brought away from the impaction plate by the high radial fluid speed. The particles have a great opportunity to be adhered in the recess because of the use of a protruding nozzle and a conical recess as well as the greater gap between the nozzle and the impaction plate than the conventional impactor.

2. The fluid entering the recess must turn its direction and exit from the center of the orifice, and hence the rebounding particles or the particles blown away from the accumulated particles layer can be trapped efficiently while the fluid is turning its direction, consequently collection efficiency and particle loading can be increased.

3. The conical recess is designed to expedite particle accumulation on the bottom without the use of viscous substance to increase particle collection efficiency rapidly.

4. The diameter of the orifice is about four times of the diameter of the nozzle, which is an appropriate size to prevent loss of particles due to unfavorable exiting flow direction if the orifice size is too small, and prevent loss of particles due to blowing out if the orifice size is too large.

Many changes and modifications in the above embodiment of the invention can, of course, be carried out without departing from the scope thereof. Accordingly, to promote the progress in science and the useful arts, the invention is disclosed and is intended to be limited only by the scope of the appended claims.

What is claimed is:

1. An inertial impactor with an impaction plate, comprising:

a nozzle element comprising a nozzle protruding from a nozzle plate; and an impaction plate formed with a conical recess partially covered by an orifice plate having an orifice, the conical recess having a circular impaction plane at a bottom of the recess with a diameter greater than a diameter of the protruding nozzle, a diameter of the orifice plate being approximately four times the diameter of the protruding nozzle so as to prevent loss of particles if the orifice size is too small, prevent loss of particles due to blowing out if the orifice size is too large, and to effectively retain the particles within the conical recess and prevent particles from being blown out of the conical recess by an air stream so that the particles can be accumulated quickly on the bottom of the conical recess and the collection efficiency can be improved accordingly.

2. The inertial impactor with an impaction plate as claimed in claim 1 further comprising a plurality of nozzles.

* * * * *